US010284976B2

(12) United States Patent
Rasmussen et al.

(10) Patent No.: US 10,284,976 B2
(45) Date of Patent: May 7, 2019

(54) HEARING AID

(71) Applicant: Oticon A/S, Smørum (DK)

(72) Inventors: Karsten Bo Rasmussen, Smørum (DK); Dennis Presutti, Smørum (DK); Troels Holm Pedersen, Smørum (DK); Lars Steen Christensen, Smørum (DK); Kenneth Rueskov Møller, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/644,442

(22) Filed: Jul. 7, 2017

(65) Prior Publication Data

US 2018/0020302 A1 Jan. 18, 2018

(30) Foreign Application Priority Data

Jul. 12, 2016 (EP) ..... 16178954

(51) Int. Cl.
*H04R 25/00* (2006.01)

(52) U.S. Cl.
CPC ..... *H04R 25/652* (2013.01); *H04R 25/60* (2013.01); *H04R 25/602* (2013.01); *H04R 25/604* (2013.01); *H04R 25/65* (2013.01); *H04R 25/654* (2013.01); *H04R 25/656* (2013.01); *H04R 25/658* (2013.01); *H04R 2225/023* (2013.01); *H04R 2225/025* (2013.01); *H04R 2460/09* (2013.01); *H04R 2460/11* (2013.01); *H04R 2460/17* (2013.01)

(58) Field of Classification Search
CPC ..... H04R 25/45; H04R 25/456; H04R 25/60; H04R 25/604; H04R 25/65; H04R 25/652; H04R 25/656; H04R 2225/023; H04R 2225/025; H04R 2460/09; H04R 2460/11
USPC ..... 381/322, 324
See application file for complete search history.

(56) References Cited

U.S. PATENT DOCUMENTS

| | | | | |
|---|---|---|---|---|
| 6,724,902 | B1 | 4/2004 | Shennib et al. | |
| 6,865,279 | B2 * | 3/2005 | Leedom | H04R 25/608 381/322 |
| 9,154,892 | B2 * | 10/2015 | Ganapathy | H04R 25/656 |
| 9,253,580 | B2 * | 2/2016 | Parsi | H04R 25/604 |
| 2004/0165742 | A1 * | 8/2004 | Shennib | H04R 25/456 381/326 |
| 2006/0291683 | A1 * | 12/2006 | Urso | H04R 25/654 381/328 |
| 2013/0129128 | A1 | 5/2013 | Wagner et al. | |
| 2017/0019740 | A1 * | 1/2017 | Caldarola | H04R 25/652 |

FOREIGN PATENT DOCUMENTS

| | | | |
|---|---|---|---|
| DE | 10 2010 041 695 | A1 | 8/2011 |
| EP | 1 246 506 | A1 | 10/2002 |
| EP | 1 434 464 | A1 | 6/2004 |
| WO | WO 95/28066 | A1 | 10/1995 |
| WO | WO 00/32009 | A2 | 6/2000 |

* cited by examiner

*Primary Examiner* — Jesse A Elbin
(74) *Attorney, Agent, or Firm* — Birch, Stewart, Kolasch & Birch, LLP

(57) ABSTRACT

A hearing device configured to be worn in an ear canal, wherein the hearing device comprises a housing, a receiver, one or more microphones and a battery. The receiver is arranged in the housing in a manner in which the receiver at least partly extends outside of the housing, and a sealing element is configured to be arranged in the bony region of the ear canal.

19 Claims, 6 Drawing Sheets

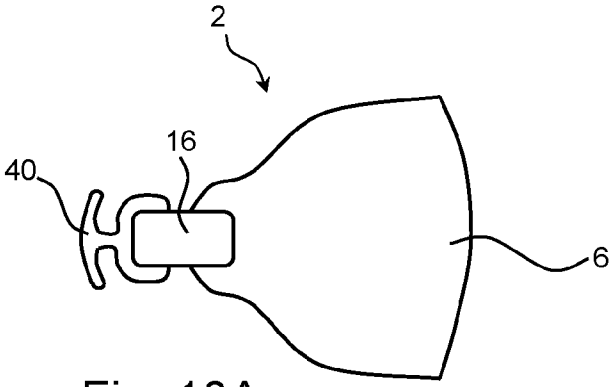
Fig. 10A
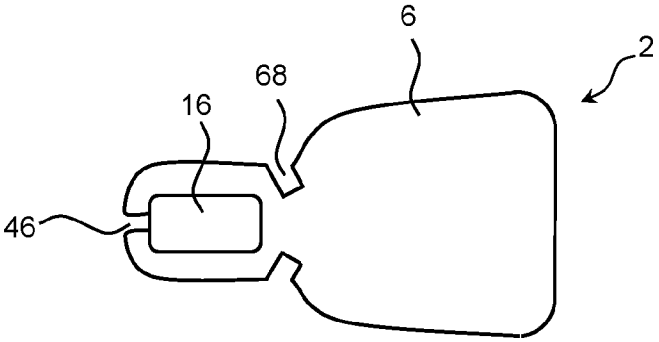
Fig. 10B
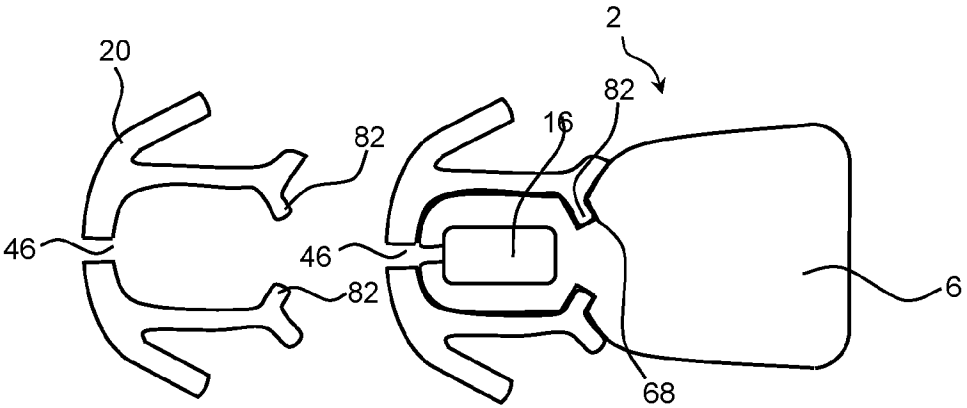
Fig. 10C
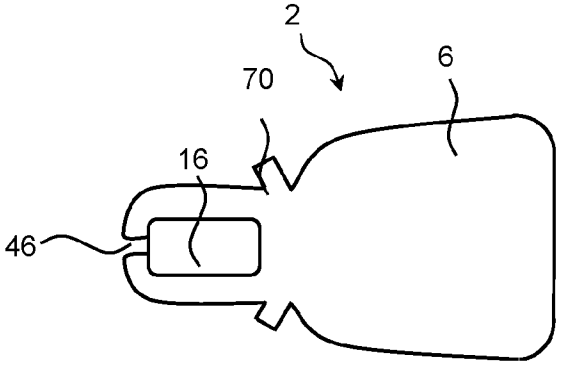
Fig. 10D
Fig. 10E

HEARING AID

FIELD

The present disclosure relates to a hearing device configured to be worn in an ear canal of a user. More particularly, the disclosure relates to a hearing device which is configured to be worn in an ear canal, so as to extend at least partly into the bony region of the ear canal.

BACKGROUND

Hearing aids as invisible-in-the-canal (IIC) hearing aids and completely-in-the-canal (CIC) hearing aids are very popular because they are worn deep within the ear canal and thus are completely or mostly invisible to the outside observer. Accordingly, the CIC/IIC hearing aid concept is very discreet.

Since the receiver is arranged close to the eardrum, the CIC/IIC hearing aid ensures immediate sound travel and less ambient noise in loud environments. CIC/IIC hearing aids are designed for daily removal and therefore the wearer needs to be comfortable inserting and removing the hearing aids deep into the ear canal.

In CIC/IIC hearing aids, however, due to the limited size of the ventilation channel (the vent) occlusion often occurs.

Therefore, there is a need to provide a solution that allows for providing an improved CIC/IIC hearing aid, wherein the sound quality is improved and occlusion effects is reduced.

It would be desirable to have an IIC hearing aid that is more discreet than the current IIC aid, while providing improved sound quality. The present disclosure provides at least an alternative to the prior art.

SUMMARY OF THE DISCLOSURE

Preferred embodiments of the present disclosure can be achieved by a hearing device as defined in claim 1 and by a method as defined in claim 11. Other preferred embodiments are defined in the dependent sub claims, explained in the following description and illustrated in the accompanying drawings.

According to an aspect of the disclosure, the hearing device is a hearing device, such as a hearing aid, configured to be worn in an ear canal of a user, wherein the hearing device comprises a housing adapted to comprise a receiver. The housing is comprises a first distal end configured to face towards the interior of the ear canal when the hearing device is arranged in the ear canal, wherein the receiver protrudes from the housing at the distal end, in a manner in which the receiver at least partly extends outside of the housing. The hearing device furthermore comprises an attachment member, said attachment member being configured to connect with the portion of the receiver protruding from the housing and is configured to receive a sealing element, such that the sealing element is configured to be removably attached to the receiver via the attachment member, wherein the sealing element is configured to be arranged in the bony region of the ear canal.

By providing this "extended receiver structure", a construction of the hearing device allowing for a deep inserted sealing element, is achieved. Hereby, it is possible to provide a CIC/IIC hearing aid, wherein the sound quality is improved and occlusion effects is reduced. Moreover, it is possible to provide an IIC hearing device that is more discreet than the prior art IIC hearing aids. Accordingly, the present disclosure provides an alternative to the prior art.

By using a hearing device according to the disclosure it is possible to seal in the innermost section of the ear canal (i.e. in the bony region) and hereby reduce or even eliminate occlusion problems and at the same time avoid the need for at least a large vent. The sound quality can be improved by not having such a vent.

It is preferred that at least a portion of the hearing device is configured to be placed in the bony region of the ear canal. That is, the hearing device may be configured to be positioned at least with a part in the bony region of the ear canal and/or a part in the elastic cartilage part (outer third) of the ear canal. By placing at least the sealing element of the hearing device in the bony region, the effects arising from occlusion of the ear canal may be avoided as a result of a substantial seal of the bony region. By arranging the receiver in the housing, so that the receiver extends outside the housing, an "extension" of the hearing aid housing, to where the dome is attached is obtained, whereby a deeply inserted dome is allowed.

The housing may have any suitable geometry and shape allowing the housing to be placed in the ear canal. The housing is preferably a custom made structure that fits the ear canal of a hearing aid user. By custom made structure, it should be understood that the housing structure is made from an ear impression of the ear canal of a user, such that a housing structure is unique for a specific hearing aid user.

The receiver may be of any suitable type and shape. The hearing device comprises one or more microphones of any suitable type and size. The one or more microphones may be arranged in any suitable position of the hearing device. Likewise, the battery may be of any suitable type and size.

The hearing device comprises a sealing element, which are arranged so as to be connected in a detachable manner directly or indirectly on at least a portion of the receiver, wherein the sealing element is configured to be arranged in the bony region of the ear canal. By detachable/removably attachment "directly or indirectly" it should be understood that: a) the sealing element is either removably connected directly to a portion of the receiver or b) the sealing element is removably attached to a "structure" that is connected to a portion of the receiver and thus the sealing element is connected to the receiver via the "structure".

Accordingly, in an embodiment, the hearing device comprises an attachment member (i.e the above mentioned "structure"), said attachment member being configured to receive said sealing element, such that said sealing element is mounted at least indirectly on said receiver via the attachment member. The attachment member (equally denoted attachment structure throughout the description) could be construed as a snout mounted in connection with the receiver.

For providing sufficient attachment to the sealing element, the attachment member in one embodiment comprises, in an end thereof, a first flange portion and a second flange portion, wherein said first and second flange portions is configured to connect with said sealing element. Accordingly, the attachment member may form the shape of an anchor and/or T-shape.

The first flange portion and the second flange portion may be provided with a bend, said bend providing a slight extension of the ends of the flange portions, such that the ends of the flange portions extends slightly in a direction backwards towards the receiver when the attachment member is connected thereto. In this way the sealing element may engage the flange portions in a snap-engagement.

In an embodiment, the attachment member may be configured, so as to be angled in relation to the hearing aid housing. That is, a part of the attachment member, such as a "channel", substantially defining a sound channel and extending from the opposite second end to the flanges may be angled, so that the attachment member as a whole is able to fit the curvature of the ear canal.

In an embodiment, the attachment member may be an independent part, separated from the housing, such that the attachment member in an embodiment further comprises a second end adapted for connecting with a flexible joint member of said hearing device. When providing the attachment member as an independent part, it is possible to also use such an attachment member in for example receiver in the ear solution hearing aids, wherein the attachment member in a similar manner as described herein may be attached to the receiver, so as to extend the sealing element further into the ear canal of the user in order to reach the bony region thereof.

It should be noted that the attachment member in other embodiments may also form an integrated part of the housing of the hearing device. In such case, it should be understood that the attachment member as such may form an elongation of a nose part of the housing (i.e. a distal end of the housing structure). In such embodiments, as will become apparent in the description, the receiver extends outside the distal end of the housing, while the "nose part" including the attachment member, is produced so as to enclose the receiver. The form and shape of the attachment member, whether forming part of the nose as such and/or being an independent part, should be understood to be the same for all embodiments described herein.

Accordingly, it should be understood that any structural feature and/or functional feature of embodiments described herein in relation to the attachment member, whether being formed as a part of the nose or being an independent part, equally applies for all embodiments.

Accordingly, in any embodiment described in relation to the attachment member, the attachment member may partly and/or as a whole be made in a flexible material, such as a rubber material, silicone material or plastic.

With regards to the sealing element, the sealing element may in an embodiment be configured as a dome, preferably a dome made in a resilient material.

By using a soft dome (e.g. made in a silicone material) and attaching the dome to the receiver either directly or indirectly it is possible to seal against the ear canal wall in the innermost section (the bony portion of the ear canal). Hereby, it is possible to reduce or even eliminate occlusion and to provide a solution that works without a vent. By eliminating the need for a vent, it is possible to improve the sound quality.

According to an embodiment, the sealing element is made of silicone, TPE or a foam material, such as polyurethane foam. A sealing element made of silicone, TPE or a foam material, such as polyurethane foam will have the ability to adapt its shape to the surrounding structure and thus seal against the ear canal wall, e.g. in the bony portion of the ear canal. Accordingly, by using a sealing element made of silicone, TPE or a foam material, such as polyurethane foam, it is possible to reduce or even eliminate occlusion and to provide a solution that works without a vent.

According to an embodiment, the hearing device comprises a flexible joint member configured to allow the sealing element to be budged relative to at least a portion of the housing, so as to allow controlled movement of the sealing element when said sealing element is guided along the ear canal upon insertion.

Hereby, the flexible joint member is adapted to provide the required relative movements/displacements between the sealing element and the housing that makes it possible to guide the sealing along the ear canal either when the sealing element is inserted or removed from the ear canal. Relative movements/displacements between the sealing element and the housing refers to linear displacements as well as rotations and combinations hereof. The flexible joint member may be provided with these required properties by using specific shapes and/or structures of either specific geometries or materials.

Thus, in an embodiment, the flexible joint member may at least partly surround the receiver, whereby potential vibration caused by the receiver may be attenuated.

In addition, in an embodiment, the flexible joint member may be made in a flexible material, such as a rubber material or a silicone material. Hereby, it is not only possible to ease the insertion of the hearing aid into the ear canal of a user, but further such choice of material makes the hearing device more resistant to mechanical shock and/or impact.

It should be noted that the receiver could be arranged in the housing without said flexible joint member, whereby a simple manufacture process can be applied and a more robust mechanical fixation of the receiver to the housing can be achieved.

In an embodiment, the flexible joint member may be attached to a nose portion constituting the distal portion of the housing, wherein the nose portion comprises a receiving structure configured to receive said flexible joint member, wherein the flexible joint member is configured to maintain the receiver in a fixed position inside said housing while allowing a portion of the receiver to protrude from the housing. Hereby, it is possible to provide a compact, bendable and flexible hearing device that can easily be inserted into the ear canal and be removed from the ear canal, wherein the sound quality is improved and the occlusion is reduced.

Accordingly for providing a guidance and one-fit of the flexible sealing member with the nose portion, the flexible joint member may in an embodiment comprise a first shoulder portion and a second shoulder portion providing an asymmetrical structure of said flexible joint member along a longitudinal axis extending through a centerline of said hearing device, wherein said first shoulder portion and said second shoulder portion is configured to connect with a first receiving structure and a second receiving structure of said nose portion. With such configuration, it is made sure that the flexible joint member can only be inserted into the nose part of the housing structure in one way. Accordingly, the receiver may subsequently also be connected with the flexible joint member in a unique direction, making sure that the receiver is always connected correctly to the flexible joint member.

According to an embodiment, the housing or the sealing element may comprise a neck portion made in a flexible or bendable material. Hereby, the flexibility of the sealing member can be increased, whereby the sealing member's ability to be guided along the ear canal during insertion or removal of the hearing device can be improved. The flexible or bendable material may be rubber, silicone or anther suitable material.

The flexibility and/or bending properties of the neck portion may be obtained by fabrication a material with a varying thickness, whereby the variability allows for a larger flexibility. Thus, the thickness of the neck portion may vary along the longitudinal axis of the neck portion. By applying a neck portion having a thickness that varies along the longitudinal axis of the neck portion, it is possible to achieve a neck portion that is capable of bending or being deformed in specific areas/position of the neck portion (e.g. at the central portion of the neck portion). Accordingly, by designing the thickness of the neck portion in a predefined manner, wherein the thickness of the neck portion is reduced in specific areas of the neck portion, it is possible to define a neck portion and hereby a sealing element that is designed to bend or be deformed in a predefined, desired manner, due to an exerted force (e.g. applied during insertion or removal of the sealing element into the ear canal).

According to an embodiment, the sealing element may comprise a filter element (such as an ear wax filter). Hereby, filter element prevents wax from entering the acoustic system and serves the additional purpose of stiffening the surrounding structure. Accordingly, it is possible to achieve a design, in which the sealing element (e.g. a dome) is soft and the neck portion of the sealing element is flexible and bendable, but formed to resist a collapse of the neck-structure when inserting the hearing device into the ear canal. The filter element (e.g. a wax filter) may preferably be arranged in the sound opening pointing towards the ear-drum.

The wax filter may also in an embodiment, be arranged in the attachment structure. Such arrangement of a wax filter provides the same effect as when arranged in the sealing element, and in addition provides a stiffening function with respect to the surrounding structure.

Throughout the disclosure, when referring to "distal end", it should be understood to define e.g. the end of the housing facing towards the interior of the ear canal when the hearing device is arranged in the ear canal. Accordingly, when referring to the proximal end e.g. of the housing, it should be understood as the end facing the outside of the ear, the part of hearing device which faces the opening of the pinna.

In accordance with the understanding of proximal and distal end, the housing comprises a first distal end configured to face towards the interior of the ear canal when the hearing device is arranged in the ear canal, wherein the receiver protrudes from the housing at the distal end, such that an output port of said receiver points in a direction towards the interior of the ear canal.

Hereby, it is possibly to achieve a housing having the ability to increase the bendability and flexibility of the hearing device and in particular the sealing elements during insertion or removal of the hearing device in the ear canal. Hereby, insertion of the hearing device into the ear canal is eased. Furthermore, by extending the receiver outside the distal end of the housing a deeply inserted sealing element can be achieved, thus providing a better seal in the bony region providing at least reduced occlusion effects.

According to an embodiment, the receiver may protrude approximately 0-10 mm, such as 3 to 4 mm or 5 mm from the distal end of the housing. Hereby, it is possible to achieve a bendable and flexible hearing device that can easily be inserted into the ear canal and be removed from the ear canal.

In other words, in one embodiment less than a fifth of the length of the receiver extends outside of the housing. In another embodiment, less than a fourth of the length of the receiver extends outside of the housing. In a further embodiment, less than a third of the length of the receiver extends outside of the housing. In an even further embodiment, more than a fifth of the length of the receiver extends outside of the housing. In another embodiment, more than a fourth of the length of the receiver extends outside of the housing. In an even further embodiment, more than a third of the length of the receiver extends outside of the housing. Additionally, in an embodiment, half of the receiver extends outside the housing.

In embodiments, where the attachment member forms an integrated part of the nose portion, the housing should be construed to comprises a nose portion constituting the distal portion of the housing, wherein the nose portion comprises an attachment structure (equal to said attachment member) configured to receive the sealing element.

Hereby, it is possible to provide a compact hearing device having a simple and easy producible structure.

According to an embodiment, the nose portion is made in a material comprising one or more of the following materials: plastic, silicone, rubber, metal, carbon fibres, aramid fibres, glass fibres. Hereby, it is possible to achieve a nose portion having desired mechanical properties e.g. large flexibility and strength.

Accordingly, in an embodiment, the sealing element is removably attached to the nose portion. Hereby, the sealing element can easily be attached to the nose portion and removed from the nose portion of the housing. Accordingly, using the hearing device will be more comfortable for the hearing device user.

The removable attachment of the sealing element to the nose portion may be achieved in several ways. One way to achieve a removable attachment of the sealing element to the nose portion is, to mechanically attach the sealing element to the nose portion by providing the sealing element and the nose portion with corresponding mechanical structures such as corresponding recesses and protrusions or other suitable mechanical structures. It is possible to removably attach the sealing element to the nose portion by applying a snap structure including a flange portion and a mechanical structure configured to removably engage the flange portion.

According to an embodiment, the sealing element is removably attached to the nose portion by means of a radially (e.g. annular) extending insert structure provided at and protruding from the inside surface of the sealing element and a corresponding (e.g. annular) recess provided in the nose portion.

According to an embodiment, the sealing element is removably attached to the nose portion by means of a radially (e.g. annular) extending recess provided at the inside surface of the sealing element and a corresponding (e.g. annular) insert structure protruding from the outside surface of the nose portion.

According to an embodiment, at least a part of the attachment member, whether being an integrated part of the nose part or an independent separate part, is angled, with an angle, $\alpha$, relative to the longitudinal axis of the housing. Accordingly, in an embodiment, the attachment member may be configured, so as to be angled in relation to the hearing aid housing. That is, a part of the attachment member, such as a "channel", substantially defining a sound channel and extending from the opposite second end to the flanges may be angled, so that the attachment member as a whole is able to fit the curvature of the ear canal. Hereby, it is possible to provide a hearing device configured to ease the insertion and/or removal of the hearing device from in and/or from the ear canal.

By the term proximal portion of the nose portion is meant the portion being nearest the point, at which the nose potion is attached to the housing. Accordingly, the proximal portion of the nose portion means the opposite portion than the free end (distal portion) of the nose portion.

In an embodiment, the nose portion is arranged and shaped to fit the inner geometry of the ear canal. Hereby, it is possible to achieve a housing that is comfortable to wear and easy to insert into the ear canal.

The hearing device may comprise a least one vent, such as a pressure relief vent. Hereby, it is possible to apply the vent to relief a small pressure build up in the ear canal. It is important to underline that the vent is not a large-sized occlusion vent but rather a small-sized relief vent configured to relief small pressures build up in the ear canal.

It is stressed that the hearing device may work without a relief vent, since small in-accuracies in the seal between the sealing element and the walls of the ear canal provide the same function as the relief vent.

In an embodiment, the vent may extend through the housing and/or through the sealing element. Hereby, it is possible to relief small pressures build up in the ear canal in an efficient manner.

Accordingly, in an embodiment, the vent may extend through the nose portion or similarly trough and/or along the attachment member. Hereby, it is possible to relief small pressures build up in the ear canal effectively.

In a second aspect of the invention, a method for fabricating a hearing device for insertion into an ear canal is provided, the method comprising the steps of:

- determining the dimensions of the ear canal of a user;
- loading data defining the dimensions of the ear canal of the user into a modelling device;
- providing the housing of the hearing device from the data loaded into the modelling device;
- installing electronics components of the hearing device in the housing, wherein the housing comprises a battery, an amplifier, and one or more microphones, wherein the method comprises the following step:
- attaching a receiver to the housing in a manner in which the receiver at least partly extends outside of the housing and is kept in the housing by attachment with a flexible joint member.

Hereby, it is possible to provide a CIC/IIC hearing aid, wherein the sound quality is improved and the occlusion is reduced. Moreover, it is possible to provide an ICC hearing device that is more discreet than the prior art IIC hearing aids.

The determination of the dimensions of the ear canal of a user may be accomplished by using any suitable methods. The shape of the ear canal may be determined by a conventional ear canal impression or by means of a scanning procedure (an ear scanning).

In a preferred embodiment, the flexible joint member and the receiver are attached to each other by means of gluing.

According to an embodiment, the method further comprises the step of: attaching an attachment member to a distal end of said flexible joint member.

In an embodiment, the attachment member may be moulded into said housing, so as to be an integrated part of said housing (i.e. forming a part of a nose part of the housing) or said attachment member is configured as an removable attachable part.

Hereby, it is possible to attach a sealing element to the nose portion and/or to the attachment member in a manner in which the sealing element is able to budge relative to the housing.

According to another aspect of the disclosure, the method comprises the following step of producing the housing of the hearing device by using a 3D printer. Hereby, it is possible to produce individual housings in accost efficient manner. The 3D printed housing structure could both be made from an ear impression so as to form a custom made hearing aid. However, it could also be made as a non-custom made housing.

In either case of being produced as a custom housing or a non-custom housing, the housing may be made in a semi-flexible material. By a "semiflexible material" is meant that the housing is preferably made in a material having a shore hardness in the range from Shore A40 to Shore D10, Shore A40 to A70, Shore A50 to Shore A60, where a Shore hardness on A40 defines a medium soft material, and a shore hardness on D10 together with shore A70 defines a medium hard material. Consequently, when the housing is made in a material as defined within this "Medium" range of Shore hardness's a better and more flexible fit could be obtained in the ear canal of hearing aid user. Furthermore, the 3D printing technics has generally developed such that housing having a shore hardness within this range may be produced by 3D printing technology. Accordingly, the housings could be made in such "semi-flexible material", such as in thermoplastic elastomers and/or silicones having a shore hardness within this "medium" range as defined herein.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 10A shows a schematic, side view of a hearing device according to an embodiment of the disclosure, wherein the sealing element has been removed;

FIG. 10B shows a schematic, side view of another hearing device according to an embodiment of the disclosure, wherein the sealing element has been removed;

FIG. 10C shows a schematic, side view of a sealing element of a hearing device corresponding to the one shown in FIG. 10D;

FIG. 10D shows a schematic, side view of a hearing device having a sealing element as shown in FIG. 10C;

FIG. 10E shows a schematic, side view of a hearing device according to an embodiment of the disclosure, wherein the sealing element has been removed;

DETAILED DESCRIPTION

Figure 1A:
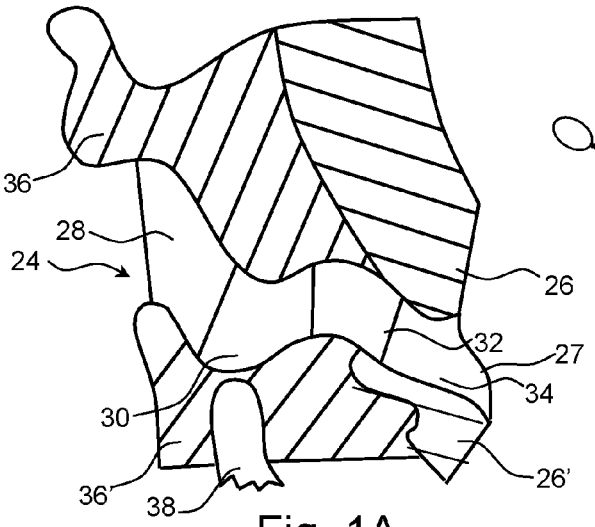
FIG. 1A shows a transverse plane of the ear canal seen from the top of the head.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by elements. Depending upon particular application, design constraints or other reasons, these elements may be implemented using electronic hardware, computer program, or any combination thereof.

The electronic hardware is not further elaborated on, but may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

In general a hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be arranged in the ear canal of the user such as In-the-Canal or Completely-in-Canal type hearing aid.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously.

Now referring to FIG. 1A, which illustrates a transverse plane of the ear canal 24 seen from the top of the head. The ear canal 24 comprises a first section 28 extending from the base of concha to the first bend of the ear canal 24; a second section 30 extending above the condule of the mandible 38 from the first bend to a second bend; a third section 32 extending from the second bend to the a fourth section 34 extending to the eardrum 27. The ear canal 24 is provided between the cartilaginous structures 36, 36' and the bony structure 26, 26'.

Regular IIC/CIC hearing aids often provides limitations on the acoustical experience of the user, due to occlusion effects when inserted into the ear canal of a user in close proximity to the eardrum 27. Therefore, the hearing device according to the disclosure aims for providing a solution that allows for providing a CIC/IIC hearing aid, wherein the sound quality is improved and the occlusion is reduced. The sound quality may be improved by arranging the sealing element deep in the ear canal. Thus, it should be noted that the hearing aid according to embodiments described herein may be arranged such that the sealing element extends into the bony region of a users ear canal. However, this does not exclude that the sealing element may also in an embodiment be provided so as to be arranged at least at the second bend of the ear canal or extend past the second bend thereof.

Figure 1B:
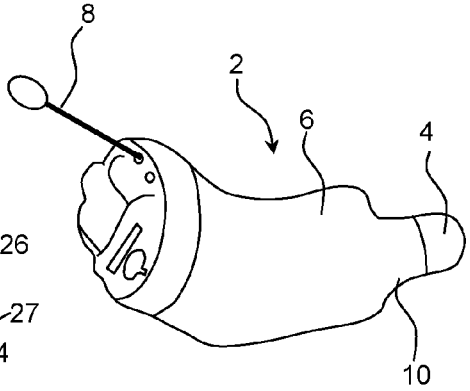
FIG. 1B shows a hearing device according to an embodiment of the disclosure.

FIG. 1B illustrates a schematic, perspective view of a hearing device 2 according to an embodiment of the disclosure. The housing 6 is adapted to comprise a receiver, one or more microphones and a battery together with other signal processing means and circuits generally used in hearing aids. The hearing aid 2 is a custom made housing 6 provided with a nose portion 10 and a front portion 4 protruding from the nose portion. The housing 6 can be custom made on the basis of dimensions of the ear canal of the user. These dimensions may be accomplished by using any suitable methods such as conventional ear canal impression or by means of an ear scanning procedure.

The hearing aid 2 further comprises a receiver (not shown) mounted partially inside and partially outside the housing 6 and extending through the nose portion 10. The hearing device in FIG. 1B, when inserted in the ear canal of a user, further comprises a sealing element (not shown).

In addition, and shown in FIG. 1B, a pull-out string 8 is attached to an end portion of the housing 6.

Figure 2A:
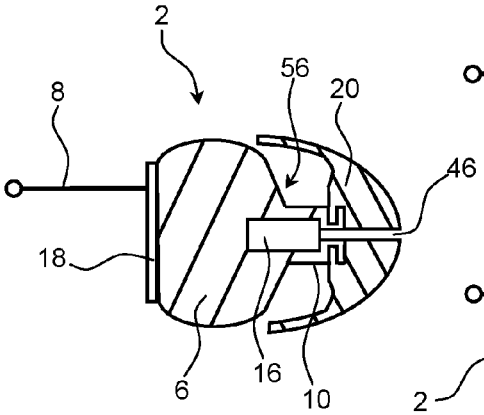
FIG. 2A shows a schematic, cross-sectional view of a hearing device according to an embodiment of the disclosure.

FIG. 2A illustrates a schematic, cross-sectional, side view of a hearing aid 2 according to an embodiment of the disclosure. The hearing aid 2 comprises a housing 6 having a distal end (a front end when inserted in the ear canal facing towards the eardrum) 56. A nose portion 10 protrudes in extension of the housing 6. An annular radially extending attachment structure 40 (i.e. also denoted attachment member throughout the description) is provided in the nose portion 10 close to a distal (free) end of the nose portion (i.e. a distal end of the nose portion arranged in a distance from the distal end 56 of the housing).

Figure 3:
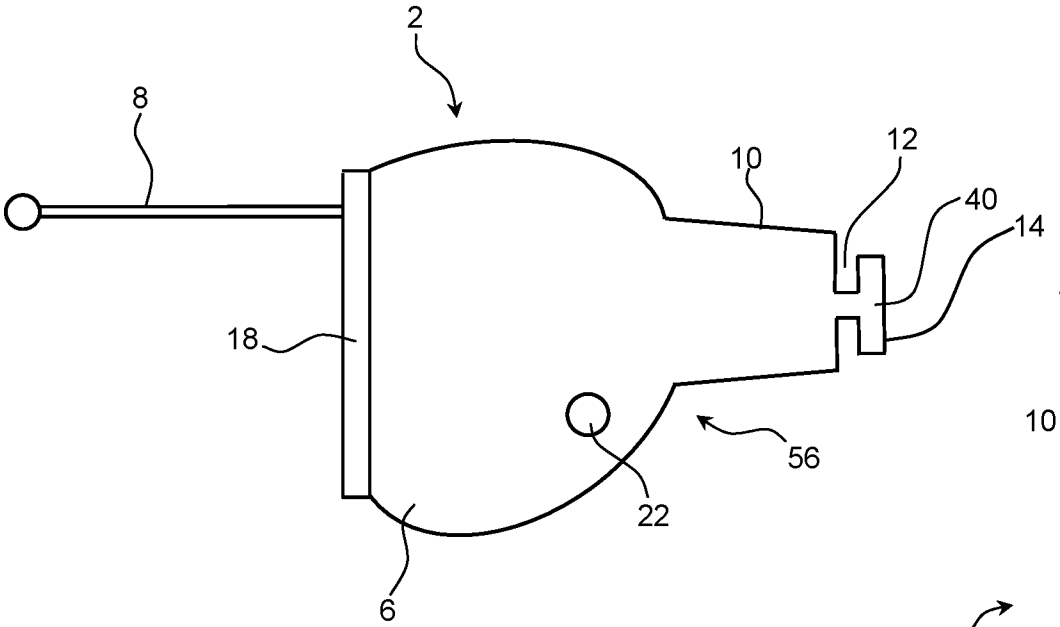
FIG. 3 shows a schematic, side view of a hearing device according to an embodiment of the disclosure, wherein the sealing element has been removed.
Figure 9:
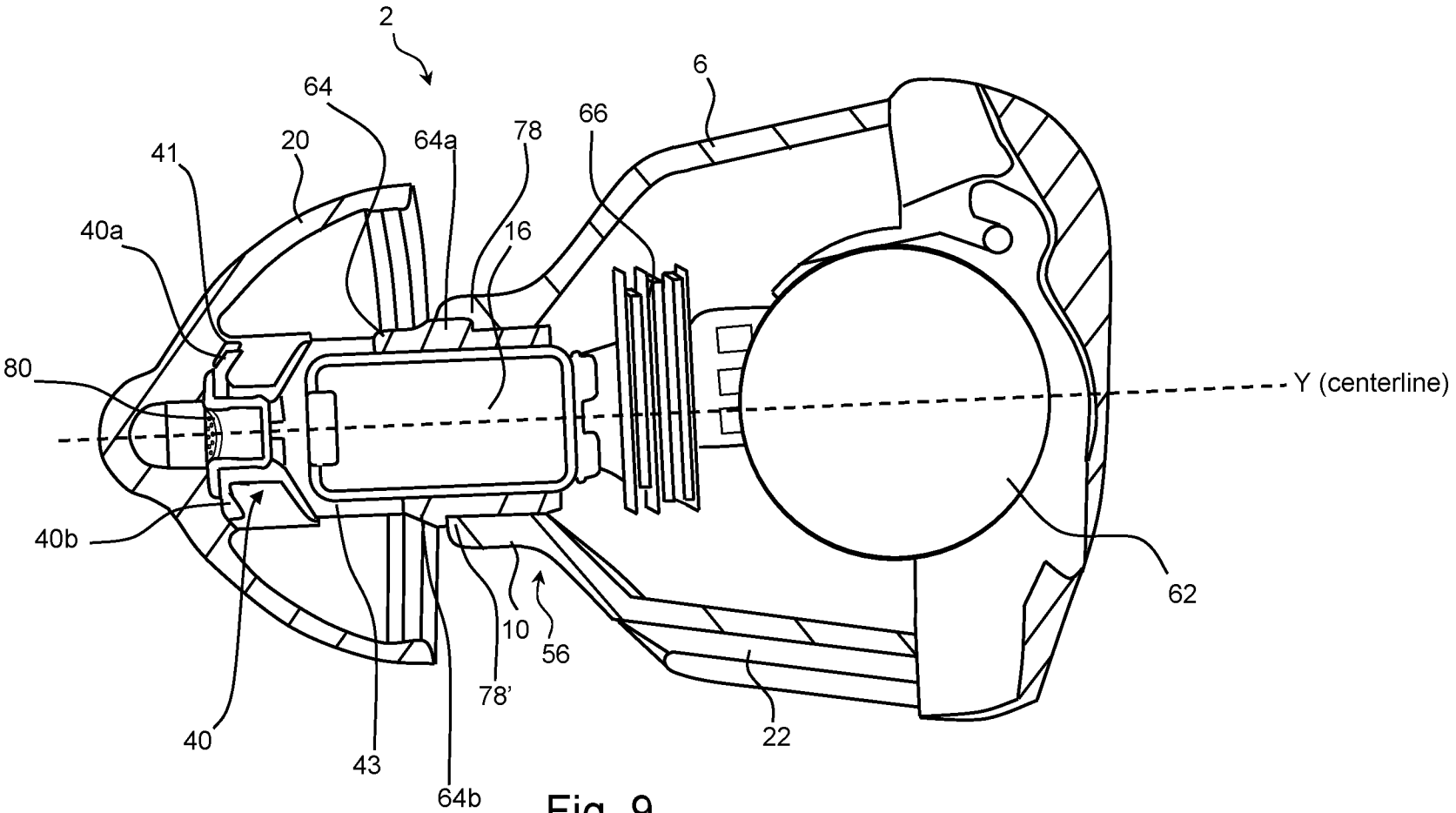
FIG. 9 shows a schematic, cross-sectional, side view of a hearing device according to an embodiment of the disclosure.

A sealing element 20 formed as a dome is removably attached to the nose portion 10 via the attachment structure 40, see e.g. FIGS. 3 and 9. The sealing element 20 comprises an annular recess structure 41 configured to be lockingly inserted into the corresponding attachment structure 40 provided at the nose portion 10. Hereby, the dome-shaped sealing element 20 can be detachably attached to the nose portion 10, such as by a snap engagement between the sealing element and the attachment structure 40. As one may consider the nose portion 10 to be part of the housing 6 of the hearing device 2, it can be argued that the sealing element 20 can be detachably attached to the housing 6 and/or the receiver.

In FIG. 2A the nose portion 10 and the housing is formed as a one-piece body. It is, however, possible to provide the housing 6 and the nose portion 10 as two separate parts that may be attached to each other by any suitable means including gluing and mechanical attachment structures such as corresponding recesses and protrusions or other suitable mechanical structures such as a snap structure including a flange portion and a mechanical structure configured to lockingly or removably engage the flange portion, which configuration will be apparent in embodiments of the disclosure.

A faceplate 18 is provided in the end portion of the housing 6 and a pull-out string 8 is attached to and protrudes from the faceplate 18. A receiver 16 is arranged in the housing 6. The receiver 16 extends from the distal end 56 of the housing 6 along the nose portion 10. A sound canal 46 extends from the receiver 16 through the distal portion of the nose portion 10 and further through the dome 20.

Figure 2B:
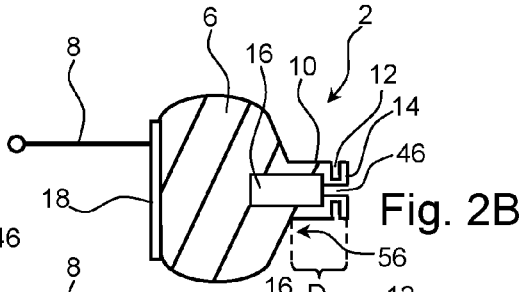
FIG. 2B shows a schematic, cross-sectional view of the hearing device shown in FIG. 2A, wherein the sealing element has been removed.
Figure 2C:
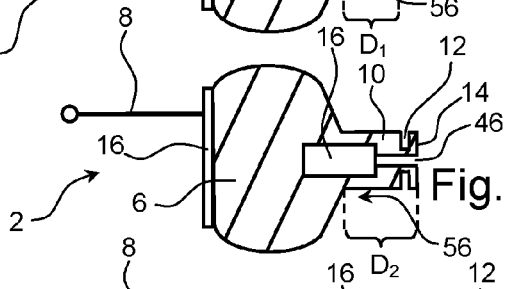
FIG. 2C shows a schematic, cross-sectional view of another hearing device according to an embodiment of the disclosure, wherein the sealing element has been removed.
Figure 2D:
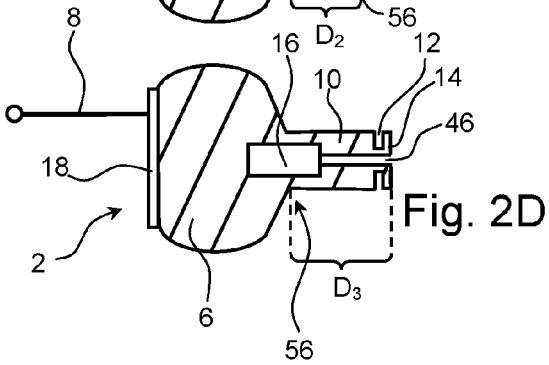
FIG. 2D shows a schematic, cross-sectional view of a further hearing device according to an embodiment of the disclosure, wherein the sealing element has been removed.

The hearing devices 2 shown in FIG. 2B, FIG. 2C and FIG. 2D are substantially identical to the embodiment of FIG. 2A and are only used for the purpose of explaining possible differences in the extend of protrusion of the receiver from the housing in relation to the length of the nose portion. In FIG. 2B the length $D_1$ of the nose portion 10 is smaller than the length $D_2$ of the nose portion 10 in FIG. 2C. Moreover, the length $D_2$ of the nose portion 10 in FIG. 2C is smaller than the length $D_3$ of the nose portion 10 in FIG. 2D. Accordingly, it can be seen that the length $D_1$, $D_2$, $D_3$ of the nose portion 10 may be individually designed or adjusted. In any case, a recess 12 is provided in the attachment structure 40 (i.e attachment member) provided at the nose portion 10 in the hearing devices 2 shown in FIG. 2B, FIG. 2C and FIG. 2D. Likewise, a sound canal 46 extends from the receiver 16 through the nose portion 10.

In view of the embodiments illustrated in e.g. FIGS. 1B to 2D and FIG. 3, it should be noted that the nose portion 10 could be configured with an angled bend in relation to a longitudinal centreline of the hearing aid housing. The bend could be configured such as to allow a flexibility of the nose portion, which flexibility upon insertion of the hearing device into the ear canal of a user, the nose portion may follow the structures of the ear canal of which the hearing aid is inserted. This aids in enhancing the comfort when inserting the hearing aid, and also provides a one-size fit all solution, whereby the flexibility allows adaptation to the structure of the ear canal. Accordingly, the bend is in an embodiment understood to be a noncustomary flexibility bending property of the hearing aid, which allows the hearing aid to follow any counters of an ear canal when inserted therein.

The bend may be formed by a flexible section in the nose portion, such that the nose portion is constructed with a rigid front part facing the interior of the hearing aid and a more flexible back part facing the interface to the receiver unit. The front can be flexible at all times or be made in a thermoforming plast, such as TPE. When the correct angle of the nose portion is adjusted to the user, the dispenser can heat or cool the nose, whereby the nose portion hardens, such that the nose portion comprises an angle which is adjusted to a specific user. It should be noted that the hardening process preferably leaves the flexible back part with a sufficient flexibility to allow the nose portion to follow the contours of the ear canal when inserted therein.

FIG. 3 illustrates a schematic, side view of a hearing device 2 according to an embodiment of the disclosure, wherein the sealing element has been removed. The hearing device 2 comprises a housing 6 provided with a pressure relief vent 22 configured to relief a small pressure build up in the ear canal. It is important to underline that the vent 22 is not a large-sized occlusion vent but rather a small-sized relief vent 22 configured to relief small pressures build up in the ear canal.

The hearing device 2 comprises a faceplate 18 and a pull-out string 8 protruding therefrom. The pull-out string 8 is adapted to be used to pull out the hearing device 2 from the ear canal. The faceplate 18 is provided at the end portion of the housing 6. In the distal portion 56 of the housing 6 a nose portion 10 extends in extension of the housing 6. The nose portion 10 is slightly conical and tapers towards the distal end 14 of the nose portion 10.

An annular recess 12 is provided in the attachment structure 40 of the nose portion 10. The annular recess 12 is configured to receive a corresponding protruding structure (not shown) of a sealing element (e.g. a dome).

Figure 4:
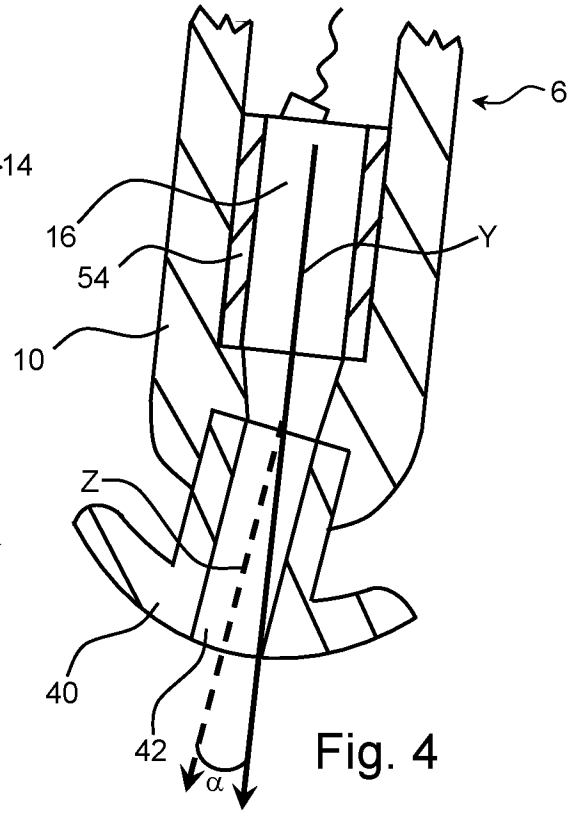
FIG. 4 shows a schematic, cross-sectional view of a hearing device according to an embodiment of the disclosure, wherein the sealing element has been removed.

FIG. 4 illustrates a schematic, cross-sectional view of a portion of a hearing device 2 according to an embodiment of the disclosure, wherein the sealing element has been removed. The hearing device 2 comprises a housing 6 provided with a nose portion 10 attached to the distal portion of the housing 6. A receiver 16 is centrally arranged in the nose portion 10. The receiver 16 is attached to the (inside surface of the) housing 6/nose portion 10 by means of an attachment element that partly surrounds the receiver 16. It can be seen that the receiver 16 extends along the longitudinal axis Y of the nose portion 10 and that an attachment member 40 (i.e. the attachment structure) is attached to the distal free end of the nose portion 10. The attachment member 40 extends along its longitudinal axis Z and comprises a cylindrical body portion provided with a throughgoing bore that function as a sound canal extending along the longitudinal axis Z. The angle $\alpha$ between the longitudinal axis Y of the nose portion 10 and the longitudinal axis Z of the attachment member 40 is indicated. Accordingly, it can be seen that the attachment member 40 is angled relative to the nose portion 10.

Accordingly, the attachment member may be configured, so as to be angled in relation to the hearing aid housing. That is, a part of the attachment member, such as a "channel", substantially defining a sound channel and extending from the opposite second end to the flanges may be angled, so that the attachment member as a whole is able to fit the curvature of the ear canal. It should be noted that any of the embodiments described herein could be provided with this angled structure of the attachment structure 40 in relation to the housing to ease insertion. The attachment member may for example be attached to the nose portion by e.g. a ball joint or other suitable means, such as mechanical snap, click or other engagement structures. In one example, the attachment member 40 is attached to a corresponding receiving structure provided in the nose portion 10.

Figure 5:
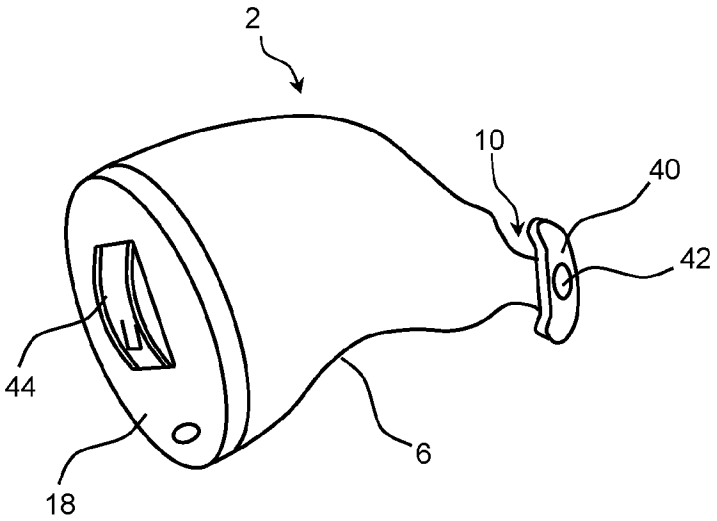
FIG. 5 shows a schematic, perspective, side view of a hearing device according to an embodiment of the disclosure, wherein the sealing element has been removed.

FIG. 5 illustrates a schematic, perspective, side view of a hearing device 2 according to an embodiment of the disclosure, wherein the sealing element has been removed. The hearing device 2 comprises a housing 6 produced to fit the geometry of the user's ear canal. A faceplate 18 is attached to the end portion of the housing 6. A battery compartment 44 for receiving and containing a battery is provided in the housing 6. A portion of the battery compartment 44 protrudes for the end faceplate 18. A nose portion 10 is provided in the distal end 56 of the housing 6. The nose portion 10 is provided with an attachment member 40 (i.e. the attachment structure) configured to lockingly receive a corresponding receiving structure provided in a sealing element (e.g. a dome). A bore 42 constitutes a sound canal 46 extending centrally along the longitudinal axis of the nose portion 10.

Figure 6:
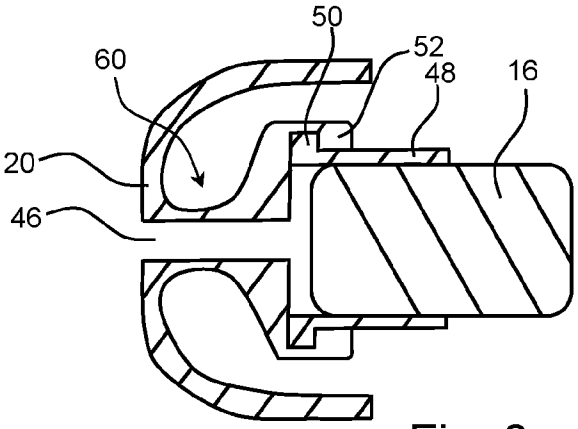
FIG. 6 shows a schematic, cross-sectional view of a portion of a hearing device according to an embodiment of the disclosure.

FIG. 6 illustrates a schematic, cross-sectional view of a portion of a hearing device according to an embodiment of the disclosure. The hearing device comprises a sealing element 20 formed as a dome provided with a centrally arranged sound canal 46 extending through the dome 20 along its longitudinal axis. The dome 20 is provided with an attachment portion 52 formed as an annular protruding structure protruding radially towards the longitudinal axis of the dome 20. An annular recess is provided next to the attachment portion 52. An attachment structure 48 having a basically cylindrical shape surrounds one half of a receiver 16 attached to attachment structure 48. The attachment structure 48 is provided with an annular protruding structure protruding radially outwardly. The attachment structure 48 engages the recess 50 in the dome 20. Accordingly, the dome 20 has been lockingly attached to the attachment structure 48. The construction shown in FIG. 6 allows for a detachably attachment of the dome 20 to the attachment structure 48. It should be noted that similar embodiments are described with similar features, where the attachment structure 48 substantially, at least in functionality in view of attaching the dome to the receiver, corresponds to the attachment structure (equally denoted member) 40. Furthermore, the recess 50 in the dome equally corresponds substantially to the recess 41 described in relation to FIG. 9.

Figure 7:
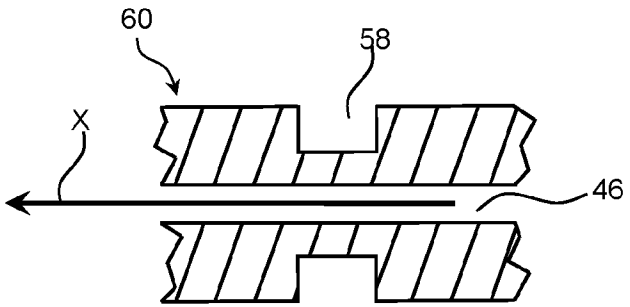
FIG. 7 shows a schematic, cross-sectional view of a portion of a neck portion of a sealing element of a hearing device according to an embodiment of the disclosure.

FIG. 7 illustrates a schematic, cross-sectional view of a portion of a neck portion 60 of a sealing element of a hearing device according to an embodiment of the disclosure. The neck portion 60 of the sealing element comprises a throughgoing sound canal 46 extending along the longitudinal axis X of the neck portion 60. One or more recesses 58 are provided in the neck portion 60. In one embodiment of the disclosure the recess 58 is formed as an annular recess. The thickness of the neck portion 60 varies along the longitudinal axis X of the neck portion 60.

By providing the neck portion 60 with one or more recesses 58 it is possible to reduce the thickness of the neck portion 60 in certain areas of the neck portion 60. Hereby, flexibility and ability to bend is increased in these areas and it is possible to achieve a neck portion 60 that is capable of bending or being deformed in specific areas/position of the neck portion 60. Accordingly, by designing the thickness of the neck portion 60 in a predefined manner, one can define a neck portion 60 and hereby a sealing element that is designed to bend or be deformed in a predefined, desired manner when a force is exerted.

Figure 8:
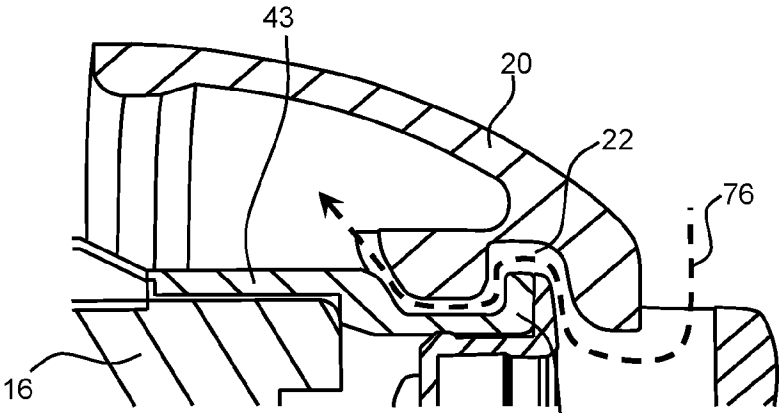
FIG. 8 shows a schematic, cross-sectional, close-up view of a portion of a dome and receiver connection in a hearing device according to an embodiment of the disclosure.

FIG. 8 illustrates a schematic, cross-sectional, close-up view of a portion of dome 20 of a hearing device according to an embodiment of the disclosure.

A pressure relief vent 22 is provided in the dome 20 and the pressure relief flow 76 is indicated. It can be seen that the dome 20 is attached to an attachment member (i.e. attachment structure) 40 surrounding a portion of the receiver 16 of the hearing device.

FIG. 9 illustrates a schematic, cross-sectional, side view of a hearing device 2 according to a preferred embodiment of the disclosure. The hearing device 2 comprises a housing 6. The housing 6 may be custom made on the basis of the dimensions of the ear canal of a user. The dimension data may be provided by means of an ear impression or an ear scanning of the ear canal.

The housing 6 comprises a battery compartment housing a battery 62. The housing 6 is provided with a nose portion 10 extending in extension of the distal end 56 (front end) of the housing 6. The nose portion 10 and the housing 6 are made as a one-piece body. The one-piece body may be made by any suitable manufacturing process, e.g. by injection moulding or 3-D printing.

The nose portion 10 may be a separate part that is attached to the housing 6 e.g. by gluing or by means of suitable mechanical parts e.g. corresponding engaging structures such as protrusions and grooves, flanges and recesses or screws.

The hearing device further comprises a flexible joint member 64 configured to allow the sealing element to be budged relative to at least a portion of the housing, so as to allow a controlled movement of the sealing element when guided along the ear canal.

The nose portion 10 and the flexible joint member 64 are interconnected by the nose portion comprising a receiving structure 78, 78' configured to receive the flexible joint member 64, such that the flexible joint member 64 is configured to maintain the receiver in a fixed position inside said housing while allowing a portion of the receiver to protrude from the housing. Accordingly, the nose portion 10 is provided with a first receiving structure 78 adapted to receive a corresponding first shoulder portion 64*a* of the flexible joint member 64 and a second receiving structure 78' which are adapted to receive a corresponding second shoulder portion 64*b* of the flexible joint member 64. The two shoulder portions is configured to provide an asymmetrical structure of said flexible joint member along a longitudinal axis extending through a centerline of said hearing device. With such configuration, it is made sure that the flexible joint member can only be inserted into the nose part of the housing structure in one way. The flexible joint member 64 works as a connection link between the sealing member 20 shaped as a dome 20 and the nose portion 10. Hereby, the flexible joint member 64 increases the ability of the sealing member 20 to be displaced and rotated relative to the housing 6 during insertion of the hearing device 2 into the ear canal and to be removed from the ear canal of the user. The joint member 64 may preferably be made in a flexible/bendable material such as rubber or silicone or another suitable material.

The front end of the receiver 16 extends out from the housing 6 and the nose portion 10 into the sealing member 20, to which the receiver 16 is at least connected via an attachment member 40. The rear end of the receiver 16 is positioned in the housing 6. The attachment member 40 is configured to receive the sealing element 20, such that the sealing element is mounted at least indirectly on the receiver 16 via the attachment member 40. According to the embodiments described herein and illustrated at least in the Figures, with at least reference to FIG. 9 and similar and in more detail in FIG. 11, the attachment member 40 in an end comprises a first flange portion 40*a* and a second flange portion 40*b*, wherein the first and second flange portions 40*a*, 40*b* is configured to connect with the sealing element 20. Accordingly, the sealing element 20 comprises a corresponding and matching recess structure 41 to which the flange portions 40*a*, 40*b* connects, when the sealing element 20 is attached to the attachment member 40.

The first flange portion and the second flange portion may be provided with a bend, said bend providing a slight extension of the ends of the flange portions, such that the ends of the flange portions extends slightly in a direction backwards towards the receiver when the attachment member is connected thereto. In this way the sealing element may engage the flange portions in a snap-engagement.

The attachment member may in accordance with the previously described embodiment be angled in relation to the hearing aid housing. That is, a part of the attachment member, such as the "channel", substantially defining a sound channel in the attachment member and extending from the opposite second end to the flanges may be angled, so that the attachment member as a whole is able to fit the curvature of the ear canal.

For connection with the receiver structure, the attachment member is further configured with a second end 43, which is adapted in shape to receive the "protruding end" of the receiver 16 and further connect with the flexible sealing member 64.

As previously elaborated on the attachment member is partly and/or as a whole made in a flexible material, such as a rubber material, silicone material or plastic. That is the flange portions 40*a*, 40*b* may be made from a material which are more flexible than the material of the end part 43 of the attachment member 40. Thus, the flange portions 40*a*, 40*b* may be made from a material allowing the flange portions 40*a*, 40*b* to bend in a small angle relative to the a centreline of the housing 6 upon insertion of the hearing aid in an ear canal of a user.

Figure 11:
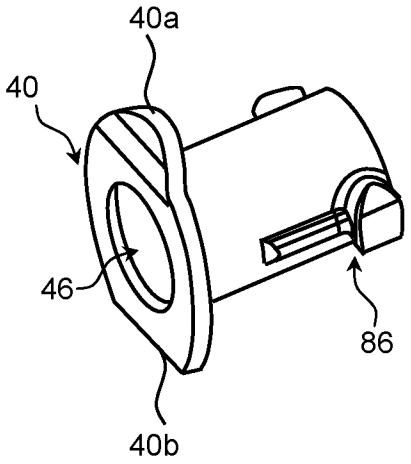
FIG. 11 shows a schematic, side view of a part with collar for attachment of a sealing element, wherein the part is adapted for being attached to the housing of a hearing device according to an embodiment of the disclosure.

An embodiment of the attachment member 40 is illustrated in more detail in FIG. 11. The attachment member 40, may be attached to a structure, such as the flexible joint member 64 of the housing 6 of the hearing device. The attachment may be by any suitable means including gluing, mechanical engagement elements 86 (e.g. protrusions and corresponding grooves or screws). The attachment member comprises flange portions 40*a*, 40*b*, which allow a dome to be detachably attached to the attachment structure. The engagement elements 86 arranged in the end portion of the attachment member 40, may be inserted to corresponding receiving structures (not shown) provided in the housing and/or the flexible joint member 64 of the hearing device. Furthermore, the part attachment member 40 is provided with a through-going sound canal 46 that enables sound to be transmitted through the sound canal 46.

Furthermore, the attachment member 40, may as previously described in relation to the nose portion, be configured with an angled bend in relation to a longitudinal centreline of the hearing aid housing. The bend could be made in order to allow a flexibility of the nose portion, such that upon insertion into the ear canal of a user, the nose portion may follow the structures of the ear canal of which the hearing aid is inserted. Furthermore, the attachment member 40 could be mounted to the receiver unit ins a rotatable manner allowing the attachment member to be rotated into position in the ear canal and/or as previously elaborated on the attachment member could be connected to the receiver by a ball joint structure, which would similarly allow a rotation and flexibility of the attachment member, easing the insertion and improving comfort when inserting the hearing aid.

The housing 6 comprises a printed circuit board (PCB) arranged between the receiver 16 and the battery 62. The PCB 66 is electrically connected to the battery 62 and the PCB is electrically connected to the receiver 16. The position of the components in the housing may be individually designed on the basis of the dimensions of the ear canal of a user. As it can be seen from FIG. 9, the construction allows for decreasing the size of the housing 6. This means that a smaller housing 6 custom made for a hearing device user with a narrow ear canal will still be capable of housing the electrical components 66, 62, 16.

A small vent 22 is provided in the housing 6. A vent 22 having a diameter of 0.2-0.8 mm, such as 0.6 mm may be sufficient. However, it should be noted that the vent 22 shown in FIG. 9 could be excluded. Similarly, the vent configuration as explained in relation to FIG. 8 could be used with the embodiment of FIG. 9.

The sealing element 20 made as a dome 20 comprises a filter 80 shaped as a wax filter. The filter 80 is configured to prevent wax from entering the dome 20 and further into the acoustic system. The filter 80 moreover has a stiffening function with respect to the surrounding structure of the dome 20.

The embodiments shown in FIGS. 10B to 10E is intended to describe at least alternative embodiments according to the disclosure. The embodiments comprises substantially the same features as already described, however where a moulding technic is preferably used to integrate a series of the feature, such as the receiver, nose portion and attachment member into a single-piece hearing aid.

FIG. 10A illustrates a schematic, side view of a hearing device 2 according to an embodiment of the disclosure, wherein the sealing element has been removed. The hearing device 2 comprises a custom made housing 6 and the features already explained at least with relation to FIG. 9 should equally apply.

In contrast to FIG. 10A FIG. 10B illustrates a schematic, side view of another hearing device 2 according to an embodiment, wherein the receiver is arranged entirely in the nose portion 10 of the housing structure 6. Accordingly the receiver and nose forms and integrated part with the housing. A recesses 68 are provided in the outside structure of the housing 6. The recesses 68 are configured to receive corresponding engagement elements (protruding structures) of a sealing element (e.g. a dome) (not shown). The recesses may be cut out by means of a tool or by using other processing elements (not shown). A sound canal 46 is provided in the front end of the housing 6.

In more detail, FIG. 10C illustrates a schematic, side view of a sealing element 20 of a hearing device 2 corresponding to the one shown in FIG. 10D and configured to be attached to the recess 68 of the housing as illustrated in FIG. 10B. The sealing element 20 is formed as a dome 20 provided with a sound canal 46 and protruding elements 82 configured to be received corresponding recesses 68 in the housing as shown in an assembled state in FIG. 10D.

FIG. 10E illustrates a schematic, side view of a hearing device 2 according to an embodiment corresponding to FIGS. 10B to 10D, wherein the sealing element has been removed. The hearing device 2 comprises a housing 6 and a receiver 16 provided in the distal end (front end) of the housing 6. In contrast to FIGS. 10B to 10D, the housing is provided with protruding structures 70. The protruding structures 70 are configured to be inserted into corresponding engagement elements (groove structures or recesses) of a sealing element such as a dome (not shown). A sound canal 46 is provided in the front end of the housing 6.

In an aspect, a data processing system comprising a processor adapted to execute the computer program for causing the processor to perform at least some (such as a majority or all) of the steps of the method described above and in the claims.

It is intended that the structural features of the devices described above, either in the detailed description and/or in the claims, may be combined with steps of the method, when appropriately substituted by a corresponding process.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more. Accordingly, the scope should be judged in terms of the claims that follows.

The invention claimed is:

1. A hearing device configured to be worn in an ear canal, wherein the hearing device comprises:

a housing adapted to comprise a receiver, said housing having a first distal end configured to face towards the interior of the ear canal when the hearing device is arranged in the ear canal, wherein the receiver protrudes from the housing at the distal end; and an attachment member, said attachment member being configured to connect with said portion of said receiver protruding from said housing and configured to receive a sealing element, such that said sealing element is configured to be attached to said receiver via the attachment member, wherein the sealing element when mounted to said receiver is configured to be arranged in a bony region of the ear canal, and wherein said attachment member in an end comprises a first flange portion and a second flange portion, said first and second flange portions being configured to connect with said sealing element.

2. Hearing device according to claim 1, wherein the hearing device comprises a flexible joint member configured to allow the sealing element to be budged relative to at least a portion of the housing, so as to allow a controlled movement of the sealing element when guided along the ear canal.

3. Hearing device according to claim 2, wherein said flexible joint member comprises a first shoulder portion and a second shoulder portion providing an asymmetrical structure of said flexible joint member along a longitudinal axis extending through a centerline of said hearing device, wherein said first shoulder portion and said second shoulder portion is configured to connect with a first receiving structure and a second receiving structure of said nose portion.

4. Hearing device according to claim 3, wherein at least a part of the attachment member is angled relative to the longitudinal axis of the housing.

5. Hearing device according to claim 2, wherein said flexible joint member is attached to a nose portion constituting the distal portion of the housing, wherein the nose portion comprises a receiving structure configured to receive said flexible joint member, wherein the flexible joint member is configured to maintain the receiver in a fixed position inside said housing while allowing a portion of the receiver to protrude from the housing.

6. Hearing device according to claim 2, wherein at least a part of the attachment member is angled relative to the longitudinal axis of the housing.

7. Hearing device according to claim 2, wherein said attachment member in an end comprises a first flange portion and a second flange portion, wherein said first and second flange portion is configured to connect with said sealing element.

8. Hearing device according to claim 1, wherein said flexible joint member is attached to a nose portion constituting the distal portion of the housing, wherein the nose portion comprises a receiving structure configured to receive said flexible joint member, wherein the flexible joint member is configured to maintain the receiver in a fixed position inside said housing while allowing a portion of the receiver to protrude from the housing.

9. Hearing device according to claim 8, wherein said flexible joint member comprises a first shoulder portion and a second shoulder portion providing an asymmetrical structure of said flexible joint member along a longitudinal axis extending through a centerline of said hearing device, wherein said first shoulder portion and said second shoulder portion is configured to connect with a first receiving structure and a second receiving structure of said nose portion.

10. Hearing device according to claim 8, wherein at least a part of the attachment member is angled relative to the longitudinal axis of the housing.

11. Hearing device according to claim 1, wherein at least a part of the attachment member is angled relative to the longitudinal axis of the housing.

12. Hearing device according to claim 1, wherein the first flange portion and the second flange portion may be provided with a bend, said bend providing a slight extension of the ends of the flange portions, such that the ends of the flange portions extends slightly in a direction towards the receiver when the attachment member is connected thereto.

13. Hearing device according to claim 1, wherein the attachment member comprises a sound channel, which along outer contours of said channel is slightly angled in relation to a centerline of said hearing aid housing, so that a bend is formed in the attachment member.

14. Hearing device according to claim 1, wherein said attachment member further comprises a second end adapted for connecting with said flexible joint member.

15. Hearing device according to claim 1, wherein the attachment member is partly and/or as a whole made in a flexible material.

16. A method for fabricating a hearing device according to claim 1 for insertion into an ear canal, where the method comprises the following steps:

determining the dimensions of the ear canal of a user;

loading data defining the dimensions of the ear canal of the user into a modelling device;

providing the housing of the hearing device from the data loaded into the modelling device;

installing electronics components of the hearing device in the housing, wherein the housing comprises a battery, an amplifier, and one or more microphones, wherein the method comprises the following step:

attaching a receiver to the housing in a manner in which the receiver at least partly extends outside of the housing and is kept in the housing by attachment with a flexible joint member.

17. Method according to claim 16, wherein the flexible joint member and said receiver are attached by gluing.

18. A method according to claim 16, wherein the method further comprises the step of attaching an attachment member to a distal end of said flexible joint member.

19. A method according to claim 16, wherein the attachment member is moulded into said housing, so as to be an integrated part of said housing or said attachment member is configured as an removable attachable part.

* * * * *